United States Patent [19]

Tripp

[11] 4,366,740

[45] Jan. 4, 1983

[54] COMBINATION BRIDGE AND TAILPIECE

[76] Inventor: Jeffrey Tripp, 79 Newton St., Somerville, Mass. 02143

[21] Appl. No.: 225,758

[22] Filed: Jan. 16, 1981

[51] Int. Cl.[3] ..... G10D 3/12

[52] U.S. Cl. ..... 84/298; 84/197; 84/214; 84/297 R

[58] Field of Search ..... 84/297 R, 298, 299, 84/307, 312 R, 312 P, 313, 197–198, 200, 204–205, 214, 264, 285, 300–302

[56] References Cited

U.S. PATENT DOCUMENTS

| | | | |
|---|---|---|---|
| 383,275 | 5/1888 | Bowers | 84/298 |
| 1,239,050 | 9/1917 | Smith | 84/264 |
| 1,603,920 | 10/1926 | O'Malley | 84/200 |
| 2,714,326 | 8/1955 | McCarty | 84/299 |
| 3,174,380 | 3/1965 | Cookerly et al. | 84/307 |
| 4,141,271 | 2/1979 | Mullen | 84/205 X |
| 4,171,661 | 10/1979 | Rose | 84/313 |
| 4,230,014 | 10/1980 | Hoshino | 84/299 |

FOREIGN PATENT DOCUMENTS

| | | | |
|---|---|---|---|
| 72716 | 1/1894 | Fed. Rep. of Germany | 84/299 |
| 3275 | of 1893 | United Kingdom | 84/205 |

*Primary Examiner*—Lawrence R. Franklin
*Attorney, Agent, or Firm*—Philip H. Gottfried

[57] ABSTRACT

An apparatus is presented for use with stringed musical instruments which replaces both a bridge and a tailpiece. The apparatus provides enhanced coupling between the string which it contacts and the body of the musical instrument by terminating the string at a point coincident with the desired speaking length, thereby virtually completely eliminating the energy loss and extraneous vibrations that occur in conventional nodal point forming systems. The apparatus includes provision for longitudinally adjusting the position of the string relative to the body of the musical instrument to obtain the proper location thereof with regard to the original octave point position of the strings over the frets.

6 Claims, 6 Drawing Figures

COMBINATION BRIDGE AND TAILPIECE

The present invention relates generally to a device for firmly anchoring a plurality of musical instrument strings and in particular to a device for attachment to a musical instrument for anchoring of the strings in a manner to increase the purity of the tone produced thereby and increase their sustain by operating in a manner to firmly couple the strings to the instrument and permit the elimination of any contact by the strings with any apparatus between the device fastened to them at one end and then contact with a "nut" prior to being connected to the tuning machines fastened to them at the other end.

Stringed musical instruments have existed in many forms over the years and today exist in various forms from conventional violins, violas, and violoncellos, through both electric and acoustic guitars of various forms as well as more exotic Eastern musical instruments such as the sitar. Virtually all of these stringed musical instruments include a main body part to which is attached at least one end of what is usually a plurality of strings. A neck is typically attached to the main body part along with the strings extend until they reach the longitudinal outer end thereof where they are fixed to the distal end of the neck, usually to some sort of tuning machine, in order to selectively apply tension to the strings. Sounds are produced by the musical instrument by plucking, strumming or bowing the strings which have been stretched between their points of attachment. The nature of the sound produced by the strings is a function of many different variables and factors including the material of which the strings are made, the manner in which the strings are constructed, the length of the strings from their point of attachment on the main body part to their point of attachment at the distal end of the neck including whether there is any intermediate support between those two points of attachment, the amount of tension applied to the strings, the nature of the attachment of the strings to the body of the musical instrument and other factors.

For the remainder of the specification, stringed musical instruments in general will be understood as being the general subject matter hereof. However, for ease of discussion, reference may be made to a specific stringed musical instrument, such as a guitar. This is not meant to limit the scope of the present invention.

In addition to the structure noted hereinbefore a guitar typically includes a saddle between the tuning machines, used for selecting and changing the tension applied to the strings, and the point of attachment of the strings on the main body of the guitar. The saddle is generally constructed and arranged to be upstanding from the plane of the main body of the guitar supporting the strings, partially for the purpose of maintaining distance between the strings of the guitar and the guitar body. This distance permits generally unrestricted movement of the guitar strings for their unsupported length in a direction generally perpendicular to the plane of the main body part of the guitar without the strings contacting the main body part of the guitar and thereby discordantly interfering with the sound produced by the string or strings. Even where a single apparatus combines the functions of a bridge and a tailpiece (the tailpiece being the main guitar body point of termination of the strings), the bridge includes a part thereof which functions as a saddle and which supports the strings in a direction perpendicular to the plane of the guitar body and over which the strings must pass in their traverse between the point of attachment thereof on the guitar body and the tuning machines.

The division of the guitar strings into the longest unsupported segment between the tuning machines and the saddle (called the "speaking length"), and the segment between the saddle and the tailpiece (often called the "afterlength"), causes numerous problems including rapid declining of the tone produced and complicates and "muddies" the sound produced by the strings by adding undesired and uncontrolled harmonics thereto.

Conventional bridges include a relatively broad surface which is fixed to the base member of the guitar with the strings being coupled to that base. Such coupling tends to foster intermodulation among the strings, being particularly pronounced in adjacent strings. The intermodulation in undesirable since it is uncontrolled.

Among the problems caused by a saddle are that the frictional forces which develop between the strings and the saddle which supports the strings results in imprecise tuning of the strings since the frictional forces may suddenly be overcome resulting in string movement after initial tuning thereof.

In addition, in view of the support of the strings at one or two locations in addition to their support at their end points, there is a loss of energy provided to the strings by the strumming or plucking in a guitar or the bowing in other stringed musical instruments. This results in a lower volume of sound produced by the guitar strings and less sustain.

The fact that guitar strings are supported at points in addition to their end points results in distortion of the notes which would normally be produced by the strings if they were not so supported as a result of unwanted and uncontrolled partials being produced by the afterlength or afterlengths.

There exists at present an imprecise coupling of guitar strings to the body of the guitar in view of present coupling apparatus making the coupling with insufficient force to prevent unwanted and uncontrolled vibration therebetween.

Vibrations which are not desired to be produced by the guitar string, whether as a result of insufficient coupling force or as a result of vibration of the afterlength, are referred to herein as "extraneous vibrations".

It is an object of the present invention to provide an apparatus for being fastened to a stringed musical instrument, such as the guitar, for supporting the strings above the body of the musical instrument in a manner to permit virtually only desired tones to be produced by the musical instrument strings and to substantially increase the sustain of such strings.

It is a more particular object of the present invention to provide an apparatus for replacement of the normal bridge or combination bridge and tailpiece of a musical instrument while simultaneously permitting the elimination of the saddle of a conventional bridge or combination bridge and tailpiece thereby increasing the volume of sound produced by the musical instrument, the purity of the sound, and the sustain of the notes produced thereby.

It is a further object of the present invention to provide an apparatus for a stringed instrument which provides for relative sonic independence among the strings, which is adjustable to permit proper tuning of the strings, which permits the selection of a desired height with respect to the body of the musical instrument and which facilitates the rapid replacement of a string when one breaks.

It is a still further object of the present invention to provide an apparatus for overcoming all of the problems with the prior art as noted hereinbefore and for accomplishing all of the above objects with apparatus which is economical to produce and adaptable to numerous different musical instruments currently in the market with either very little or no modification and which may be incorporated into stringed musical instruments as original equipment.

Broadly, the apparatus of the present invention includes a device for securely fastening at least one sound producing member to and for supporting said member above a musical instrument in a manner to permit relatively pure tone production thereby with virtually unimpeded sustain. The apparatus comprises means for anchoring the sound producing member near one end of the sound producing member so that any extraneous vibration between the sound producing member and the anchoring means is virtually eliminated. Means are provided for adjustably mounting the anchoring means a sufficient distance above the surface of the musical instrument to permit unimpeded use thereof to produce sound. The mounting means is constructed and arranged to virtually eliminate any extraneous vibration between the musical instrument and the mounting means. The sound producing member is unsupported between the anchoring means and the support for the other end thereof so that virtually all of the energy imparted to the sound producing member produces sound of a desired tone.

The above brief description, as well as further objects, features, and advantages of the present invention will be more fully understood by reference to the detailed description of the presently preferred but nonetheless illustrative embodiment in accordance with the present invention when taken in conjunction with the accompanying drawing, wherein.

Figure 1:
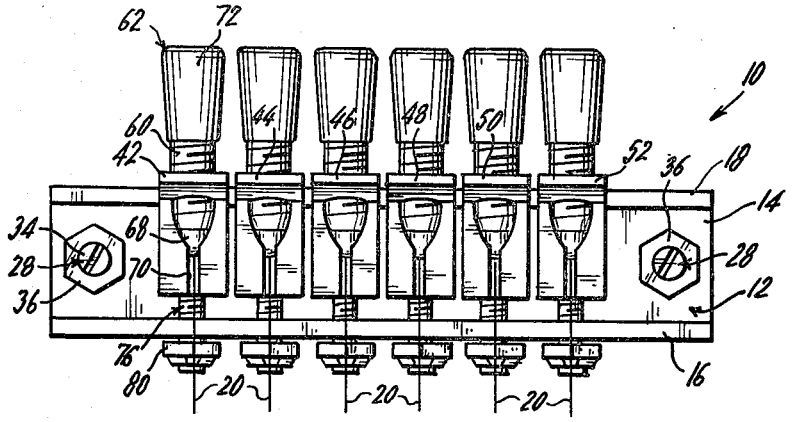
FIG. 1 is a top plan view of an illustrative form of the present invention shown prior to adjustment of the strings attached thereto.

Referring now specifically to the drawing and first to FIG. 1, in accordance with an illustrative embodiment demonstrating objects and features of the present invention, there is provided a combination bridge and tailpiece apparatus generally designated by the reference numeral 10.

The combination bridge and tailpiece apparatus 10 has the major components thereof preferrably made of brass with the exception of the screw parts thereof, to be described, which are preferrably made of stainless steel. However, it is possible to fashion the various parts of the subject apparatus of other materials such as bronze or other materials which possess variant resonant and/or tonal properties without departing from the spirit or essential characteristics of the subject invention.

Figure 2:
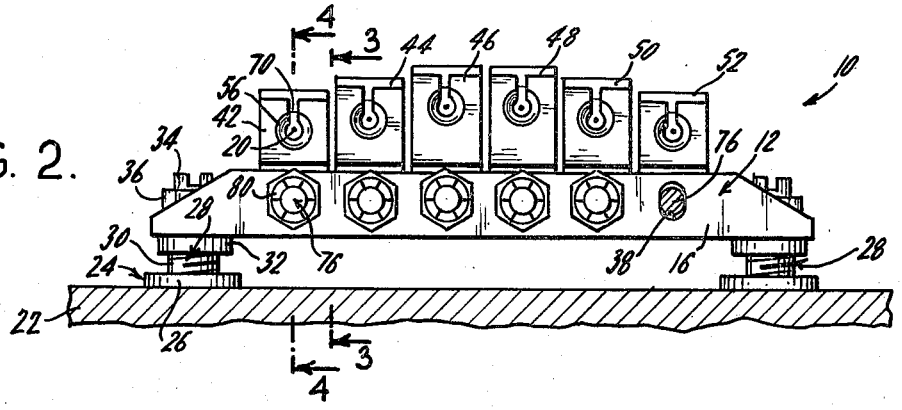
FIG. 2 is a front plan view of the device of the present invention with a part thereof broken away and shown in section.
Figure 6:
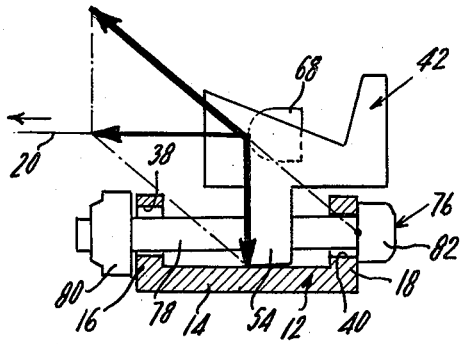
Figure 4:
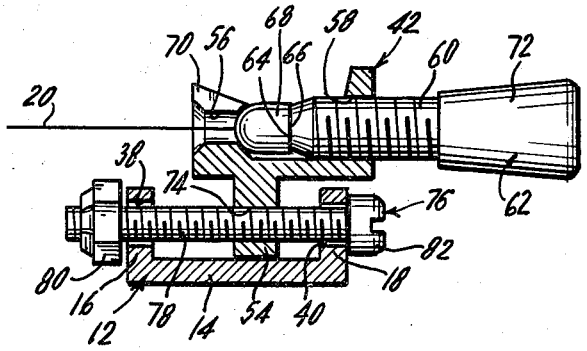
FIG. 4 is an enlarged right side sectional elevational view taken substantially along the line 4—4 in FIG. 2 and looking in the direction of the arrows.
Figure 3:
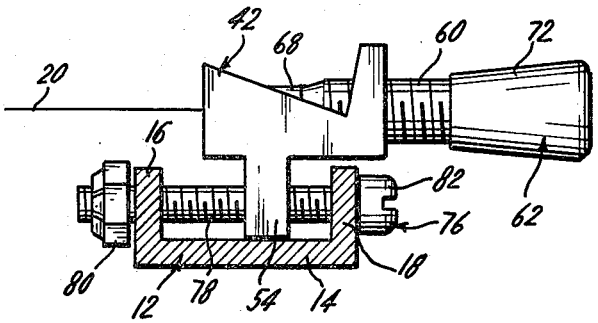
FIG. 3 is an enlarged right side sectional elevational view taken substantially along the line 3—3 of FIG. 2 and looking in the direction of the arrows.

The bridge and tailpiece apparatus 10 includes a base 12 which is generally U-shaped in cross-section as best seen in FIGS. 3, 4, and 6 and which includes a bottom wall 14 and front and rear upstanding sidewalls 16, 18. Throughout the specification, the part of the subject apparatus 10 which is closest to the neck of the musical instrument will be referred to as the "front"; the part of the apparatus 10 which is furthest from the neck of the musical instrument will be referred to as the "rear" thereof; and the "longitudinal" direction will refer to the major direction in which the strings extend. Similarly, the "left" and "right" directions will be as seen in FIGS. 1 and 2. In addition, as noted hereinbefore, while the apparatus 10 will be described with regard to its use on a guitar, it is to be understood that the subject apparatus has application to other stringed musical instruments as well.

Since one of the primary objects of the subject apparatus is to properly and as completely as possible couple the vibrating strings to the guitar body and eliminate extraneous vibration between musical instrument strings designated herein by reference numeral 20 and the main body part 22 of the musical instrument (see FIG. 2), the base 12 includes provision for firm attachment thereof to the main body of the musical instrument. In the preferred embodiment, the method of attachment includes an internally threaded bushing 24 (see FIGS. 2 and 5) which is firmly attached to the main body part 22 of the musical instrument by any conventional means, such as by being forced into an opening therein. The busing 24 may be retained in the body 22 by frictional forces, with the aid of an appropriate cement or adhesive or it may be kept therein by some other conventional means. An upper shoulder 26, of greater diameter than the main body of the bushing, contacts the upper surface of the main body part of the musical instrument 22. A similar internally threaded bushing 24 is located in the main body part 22 of the musical instrument adjacent each left and right end of the base 12 may be seen most clearly by reference to FIG. 2.

Figure 5:
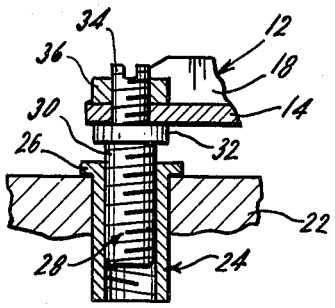
FIG. 5 is an enlarged fragmentary front sectional elevational detail view showing the manner of attachment of the subject apparatus to the body of a musical instrument; and, FIG. 6 is an enlarged, right side sectional elevational diagramatic view, generally similar to FIG. 3, showing the forces acting on the apparatus of the subject invention.

A mounting stud 28 includes a larger diameter, lower segment 30 which is externally threaded and sized to be received within the internally threaded part of the bushing 24 (see FIG. 5). The stud 28 includes a still-larger-diameter collar 32 approximately one third of the way down from a slotted, threaded, smaller-diameter upper segment 34, for a purpose to be described hereinafter.

In mounting the base 12 to the main body part 22 of the musical instrument, one mounting stud 28 is threaded with its lower segment 30 thereof into each one of the bushing 24 with the collars 32 thereof located a predetermined distance above the surface of the main body part 22 of the musical instrument. The base 12 is provided with left and right openings therein (not shown) which are located and sized to pass over the upper segments 34 of the mounting studs 28 until the lower surface of the bottom wall 14 of the base contacts the upper surface of the collars 32. Adjustment of the height of the base and the apparatus carried thereby with respect to the upper surface of the main body part 22 of the musical instrument is accomplished by inserting a flat-bladed screwdriver in the slots within the upper segment 34 of the mounting studs 28 and turning the same within bushings 24. After the desired height of the apparatus 10 has been reached, left and right fastening nuts 36 are threaded on the upper segment 34 of the mounting studs 28 and tightened onto the upper surface of the bottom wall 14 thereby firmly attaching the base 12 to the main body part 22 of the musical instrument.

The front and rear walls 16, 18 of the base 12 are provided with a plurality of pairs of longitudinally aligned openings 38, 40 which may be circular. However, in the preferred embodiment, the opening 38 is oval with the longer axis thereof extending in the vertical direction as viewed in FIG. 2, all for a purpose to be described hereinafter.

Since the preferred embodiment of the subject apparatus 10 shown in the accompanying drawing is adapted for use with a six-string guitar, six generally similar, generally Z-shaped string-encapturing members 42, 44, 46, 48, 50, and 52 are provided. As may be seen by reference to FIGS. 1 and 2, the string-encapturing members 42 through 52 are, in view of the nature of the typical construction and arrangement of the strings 22 on a six-string guitar, provided in three different sizes and arranged symmetrically about the longitudinal centerline of the apparatus 10. The sizes of the string-encapturing members 42 through 52 may be varied to suit the individual preference of the player of the guitar or other musical instrument. As may be seen most clearly by reference to FIGS. 3 and 4, the string-encapturing member 42 has the general shape of the letter "Z" in a lying-down configuration and includes a depending member 54 which is part of and depends from the middle of the "Z" and which rests with its lower surface on the upper surface of the bottom wall 14 of the base 12. The height of the depending member 54 with respect to the main body of the string-encapturing member 42 is at least partially what determines the member's height above the front and rear walls 16, 18 of the base 12 and must be sufficient to always provide clearance between the lowermost surface of the middle of the "Z" and the top surfaces of the walls 16, 18 of the base 12 irrespective of the front or rear position of the member 42 within the base and also irrespective of the degree of tilt thereof as seen diagramatically in FIG. 6 and as discussed in greater detail hereinafter.

The front end of each of the members typified by the member 42 includes an opening 56 therein which is generally conical and diverging at the front and rear faces thereof for a purpose to be described hereinafter. The opening 56 is not threaded. The rear, upstanding, shorter leg of the "Z" of the members similar to the member 42 (as well as the member 42 itself), include an internally threaded opening 58 therein which is coaxial with the opening 56.

The height of the axis of the opening 56 above the top surface of the main body of the musical instrument 22 may be selected to suit the individual preferences of the player by selecting a string encapturing member of appropriate size and configuration. However, it is selected to always provide sufficient clearance between the strings 20 to be carried thereby and the uppermost part of the apparatus 10 exclusive of the string-encapturing member 42. This configuration results in a string which is supported at one end only by the subject apparatus and at the other end by the nut and which does not have the purity of the tone produced thereby marred by unwanted extraneous vibrations.

The opening 58 is sized to receive the externally threaded part 60 of a string end retaining member 62 which is substantially identical in each one of the string encapturing members 42, 44, 46, 48, 50, and 52. The front end of the threaded part 60 is a truncated cone which ends in a planar front end face surface 64 and which is sized and configured to mate with a planar end face 66 which is at the rear end of a string termination member 68 which captures one end of the string 22 and is affixed thereto by any convenient method, such as by being swaged thereon.

While the subject apparatus 10 can be used with any device which is designed to effect virtually extraneous vibration-free connection between the end of a string and a front-to-rear adjustable string carrier, such as the string encapturing device typified by string encapturing member 42, the preferred embodiment is constructed and arranged to utilize swaged-on string-end-terminations having a diameter no larger than 0.177 inches currently commercially available under the trademark SUPER BULLETS. With appropriate clamping arrangements (not shown) it is possible to use regular ball-end strings or strings with no special termination and still remain within the meaning and range of equivalence of the subject invention.

With the preferred embodiment of the subject invention, the string end termination member 68 is designed to be accepted within the interior of the string encapturing member 42 with the front end thereof abuting the generally conical rear face of the opening 56. In order to permit rapid changing of strings, the front part of the string-encapturing of strings, the front part of the string-encapturing member 42 includes a longitudinally extending slot 70 as may be seen by reference to FIGS. 1, 2, and 4. The slot 70 permits insertion of the string termination member 68 into the string encapturing member 42 when the string end retaining member 62 is rotated so as to move the cylinder 60 rearwardly by the use of a rear handle member 72 sufficiently to permit insertion of the member 68 with its front surface abuting the rear conical surface of the opening 56 whereupon the handle 72 is rotated to bring the front planar face 64 of the cylinder 60 to abut the rear face 66 of the member 68 thereby firmly seating the string 20 and member 68 within the string-encapturing member 42.

As may be noted by reference to FIGS. 4 and 6, the string-encapturing member, in view of the construction and arrangement of the subject apparatus, tends to establish line contact with the upper surface of the bottom wall 14 of the base 12 (seen as a point contact most clearly in FIG. 6). Further, the interconnection between the string-encapturing member 42 and the opening 40 in the base 12 is such that minimum contact generally obtains thereat as well, as described hereinafter. Since each of the string-encapturing members 42 enjoys this specific relationship with the base member 12, each tends to remain somewhat isolated from its adjacent members and unwanted intermodulation is reduced.

With the apparatus just described, it is possible to exert a force on the string end termination member 68 of as much as two hundred (200) pounds per square inch thereby ensuring the virtual elimination of extraneous vibration between the string end termination member 68 and the string encapturing member 42. The force which may be exerted is only required to be of sufficient magnitude to prevent unwanted movement of the string termination member 68. The subject apparatus 10 permits application of force thereto which is a significant increase over any prior apparatus for applying string-end capturing forces, presently available in the market. If desired, the interior of the handle 72 can include at its rear end, a generally hexagonal-shaped recess for insertion therein of an Allen wrench or the like to aid in applying the appropriate amount of force to the string end termination member 68.

Within the lower extent of the depending member 54 and coaxial with the openings 38, 40 in the upstanding front and rear walls 16, 18 of the base 12 when the bottom of the member 54 abuts the top surface of the bottom wall 14, is an internally threaded opening 74 (see FIG. 4) for a purpose to be described hereinafter.

A positioning bolt 76 is located within and passes through each of the front and rear openings 38, 40 in the walls 16, 18. The threaded segment 78 of the bolt 76 is sized to mate with the internally threaded opening 74 within the depending member 54 of the string encapturing member 42 for positioning thereof, in a manner and for a purpose to be described, and includes an appropriate retaining member on its forward end, such as a locking nut 80 with a bolt head 82 being located at the rear end thereof. As may be seen by reference to FIGS. 4 and 6, the positioning bolt 76 and the openings 38, 40 are sized and configured so that the bolt passes through but is not threaded within the openings 38, 40.

In operation, either the bushings 24 are inserted at the appropriate location within the main body 22 of a musical instrument such as a guitar; or a previously-existing bridge or combination bridge and tailpiece is removed and the mounting studs 28 are inserted within in-place bushings with the collar 32 at an appropriate location above the upper surface of the main body. If the existing openings within the main body part of the guitar or other musical instrument are not sufficiently large in diameter to be able to withstand the forces which will be acting thereon, separate means (not shown) may be provided for firmly anchoring the base 12 to the guitar body in order to effect the proper coupling of the strings to the guitar body and aid in the virtual elimination of extraneous vibrations.

The base 12 is then placed with the openings therein over the upper segment 34 of the mounting studs 28 until the lower surface of the bottom wall 14 abuts the upper surface of the collars 32. The nuts 36 are then threaded onto the upper segments 34 of the studs 28 and drawn tight by the use of an appropriate tool of conventional design, such as an open end or box wrench or the like.

As can be appreciated, each apparatus made in accordance with the teachings of the present invention will include a number of string encapturing and restraining members and associated positioning mechanisms (comprised of an appropriate number of openings within the front and rear walls 16, 18 of the base 12 and a corresponding number of positioning bolts 78 and nuts 80) corresponding to the number of strings in the stringed musical instruments with which the same is to be used. The string end retaining members 62 are rotated so as to have the planar end face 64 thereof at a position which would permit introduction into the string encapturing members (such as those designated by reference numerals 42, 44, 46, 48, 50 and 52), of the string termination members 68 with the rounded forward portion thereof placed within the rear conical part of the opening 56 with the strings 20 extending forwardly through the opening 56 and coaxial therewith toward their point of attachment at their other end to their respective turning machines (not shown).

A moderate amount of tension is exerted longitudinally forwardly on the strings 20 to firmly seat the string termination members 68 within the rear conical part of the openings 56 and the string restraining members 62 are rotated to bring the planar face 64 thereof to bear with some force (as much as, for example, 200 pounds per square inch) against the rear planar face 66 of the string termination members 68. Initially, the string end restraining members are tightened against the string termination members as tight as possible using finger pressure. If necessary, the additional assistance of an Allen wrench might be used, placed in the optional rear hexagonal-shaped opening within the handle member 72 of the string end restraining member 62. By the use of as much as three hundred (300) pounds per square inch of pressure exerted on the string termination member, there is assured adequate coupling between the string and the combination of the string termination member 68, the string end restraining member 62 and the string encapturing member 42 to thereby eliminate extraneous vibration therebetween.

The slotted end of the head 82 of the positioning bolt 76 may then be utilized by rotating the same to longitudinally position the string encapturing member 42 carried thereby on the musical instrument in order to have the "speaking length" of the particular string 20 captured thereon at the correct location with regard to the remainder of the musical instrument so that the appropriate parts thereof would be located at the correct location with respect to the frets on the neck of the musical instrument. Since this speaking length location varies, depending upon the particular string, when the musical instrument is ready for play, the various string encapturing members 42, 44, 46, 48, 50, and 52 and associated apparatus would not be in the initial position prior to adjustment thereof as shown in FIG. 1. Rather, they would be at different longitudinal locations with respect to the apparatus 10.

Once the musical instrument had all of the strings 20 tuned to the correct frequency of vibration, the forces acting on the subject apparatus would be as shown diagramatically in FIG. 6 and would result in a force on the apparatus 10 which would tend to rotate the string encapturing members 42 about the forward edge of the depending leg 54 thereof. This, in turn, results in the skewed configuration of the positioning bolt 76 which has been somewhat exaggerated in FIG. 6 for the sake of illustration. The positioning bolt 76 tends to bear against the bottom of the opening 38 at the front, tends to bear against the top of the opening 40 at the rear thereof; and, the head 82 bears against the rear face of the rear wall 18. The forward edge of the depending member 54, therefore, bears a large part of the forces acting thereon. This resolution of forces results in a connection between the string 20 and the musical instrument main body part 22 through the interconnection and interaction of the elements described hereinbefore which is relatively completely free of extraneous vibrations.

This solid, virtually extraneous-vibration-free connection of the string end to the musical instrument greatly increases the sustain of any tone or combination of tones produced by the string 20 and increases dramatically the purity of the tones produced thereby. In addition, the lack of any intermediate support between apparatus of the subject invention and the nut at the other end of each of the strings results in relatively pure sounds being produced by the strings and also results in virtually all of the energy added to the strings being utilized to produce such tones thereby increasing the amplitude of the sounds produced as well as their purity and sustain. This has been accomplished while eliminating the distortion which is often associated with the use of the saddle of a conventional bridge, by eliminating the so-called "afterlength" with the attendant unwanted tones produced thereby without the extreme bending over saddles sometimes utilized in an attempt at increasing the sustain of a string.

As will be readily apparent to those skilled in the art, the invention may be used in other specific forms or for other purposes without departing from its spirit or essential characteristics. For example, if it is desired to utilize the subject invention for replacement of the presently-existing combination bridge/tailpiece units which are not usable with the members disclosed herein for mounting the subject invention to the body of a musical instrument, other mounting members can be utilized which will permit use of the subject invention in a form similar to that disclosed herein including the basic teachings of the apparatus disclosed. Further, the base 12 need not be "U-shaped" in cross-section (see FIGS. 3, 4, and 6) but may be "L-shaped" in cross-section (without the front arm of the "U"). The present embodiment is, therefore, to be considered as illustrative and not restrictive, the scope of the invention being indicated by the claims rather than by the foregoing description, and all changes which come within the meaning and range of equivalence of the claims are therefore intended to be embraced therein.

What is claimed is:

1. Apparatus for securely fastening at least one musical instrument string and for supporting said string member with respect to a musical instrument in a manner to permit relatively pure tone production thereby with virtually unimpeded sustain, said apparatus comprising: means for anchoring said string proximate an end thereof in a manner to virtually eliminate any extraneous vibration between said string and said anchoring means; said anchoring means being constructed and arranged for receiving said string end and including means for removably clamping said string end thereto; and means for adjustably mounting said anchoring means, in a manner to eliminate extraneous vibration of said string with respect to said musical instrument, a sufficient distance from the surface of the musical instrument to permit unimpeded use of said string to produce sound; said mounting means being constructed and arranged for being fixed relative to said musical instrument to virtually eliminate extraneous vibration between said mounting means and said anchoring means and to permit mounting of said string unsupported between said anchoring means and a support for the other end thereof whereby virtually all of the energy imparted to said string produces sound of desired tone.

2. Apparatus for securely fastening at least one musical instrument string having a string termination member fixed to an end thereof and for supporting said string with respect to a musical instrument in a manner to permit relatively pure tone production thereby with virtually unimpeded sustain, said apparatus comprising: means for anchoring said string proximate one end thereof in a manner to virtually eliminate any extraneous vibration between said string and said anchoring means, said anchoring means being constructed and arranged for receiving said string termination member and including means for removably clamping said string termination member thereto; and means for longitudinally adjustably mounting said anchoring means, in a manner to eliminate extraneous vibration of said string with respect to said musical instrument, a sufficient distance from the surface of the musical instrument to permit unimpeded use of said string to produce sound; said mounting means being constructed and arranged for being fixed relative to said musical instrument to virtually eliminate extraneous vibration between said mounting means and said musical instrument; said apparatus being constructed and arranged to permit mounting of said string unsupported between said anchoring means and a support for the other end thereof whereby virtually all of the energy imparted to said string produces sound of desired tone.

3. The invention according to claim 2, said anchoring means being further constructed and arranged to permit vibration of said string without contact between said string and said anchoring means at a location longitudinally forward of said termination member's contact therewith.

4. A combination anchor and elevation end support apparatus for a plurality of musical instrument strings comprising: a base, generally U-shaped in cross-section, arranged with the bottom of the U parallel to the main body part of a musical instrument; means for mounting said base to said musical instrument to be adjustable in height with respect thereto with the arms of said U extending transversely thereof; a plurality of generally Z-shaped string capturing and anchoring members, each being constructed and arranged for removably capturing the end of a string and including means for anchoring the end of said captured string thereto; means for locating each of said capturing and anchoring members relative to said base, contacting the bottom of said base between the arms thereof; and, means operatively connecting each of said capturing and anchoring members and said base, and being constructed and arranged for permitting relative longitudinal movement of each of said capturing and anchoring members to selected locations between two predetermined end positions whereby said strings may be positioned relative to said base and said musical instrument between said predetermined locations in a manner to virtually eliminate any relative extraneous vibration between, on the one hand, said capturing and anchoring members and, on the other hand, said base.

5. Apparatus for securely fastening at least one musical instrument string having a string termination member swaged to an end thereof and for supporting said string above a musical instrument in a manner to permit relatively pure tone production thereby with virtually unimpeded sustain, said apparatus comprising: means for anchoring said string proximate one end thereof in a manner to virtually eliminate any extraneous vibration between said string and said anchoring means, said anchoring means being constructed and arranged for receiving said string termination member and including means for removably clamping said string termination member thereto; and means for longitudinally adjustably mounting said anchoring means, in a manner to eliminate extraneous vibration of said string with respect to said musical instrument, a sufficient distance from the surface of the musical instrument to permit unimpeded use of said string to produce sound; said mounting means being constructed and arranged for being fixed relative to said musical instrument to virtually eliminate extraneous vibration between said mounting means and said musical instrument; said apparatus being constructed and arranged to permit mounting of said string unsupported between said anchoring means and a support for the other end thereof whereby virtually all of the energy imparted to said string produces sound of desired tone.

6. The invention according to claim 5, said anchoring means being further constructed and arranged to permit vibration of said string without contact between said string and said anchoring means at a location longitudinally forward of said termination member's contact therewith.

* * * * *